US009239205B2

(12) United States Patent
Cummings

(10) Patent No.: US 9,239,205 B2
(45) Date of Patent: Jan. 19, 2016

(54) TOY PROJECTILE LAUNCHER WITH SPRING LOADED SPOOLS

(71) Applicant: Peter Cummings, Tsim Sha Tsui (HK)

(72) Inventor: Peter Cummings, Tsim Sha Tsui (HK)

(73) Assignee: KMA Concepts Limited, Tsim Sha Tsui, Kowloon (HK)

( * ) Notice: Subject to any disclaimer, the term of this patent is extended or adjusted under 35 U.S.C. 154(b) by 54 days.

(21) Appl. No.: 14/138,121

(22) Filed: Dec. 22, 2013

(65) Prior Publication Data

US 2015/0176940 A1 Jun. 25, 2015

(51) Int. Cl.

| | |
|---|---|
| ***F41B 3/02*** | (2006.01) |
| ***F41B 5/00*** | (2006.01) |
| ***F41B 3/00*** | (2006.01) |
| ***F41B 7/08*** | (2006.01) |
| ***F41B 5/12*** | (2006.01) |
| ***F42B 6/00*** | (2006.01) |
| ***F41B 7/00*** | (2006.01) |
| *F41B 5/14* | (2006.01) |

(52) U.S. Cl.

CPC ... *F41B 7/08* (2013.01); *F41B 3/02* (2013.01); *F41B 5/0094* (2013.01); *F41B 5/12* (2013.01); *F41B 7/00* (2013.01); *F42B 6/00* (2013.01); *F41B 5/00* (2013.01); *F41B 5/1484* (2013.01)

(58) Field of Classification Search

CPC ..... F41B 5/0094; F41B 7/08; F41B 5/1484; F41B 3/02; A63F 9/02582; F42B 6/00

USPC ..... 124/16, 17, 20.1, 20.3, 22, 23.1, 25.6

See application file for complete search history.

(56) References Cited

U.S. PATENT DOCUMENTS 1,153,415 A * 9/1915 Beaty ..... F41B 5/14 124/1
2,995,129 A * 8/1961 Malott ..... F41B 3/02 124/20.1
3,974,820 A * 8/1976 Ott ..... F41B 3/02 124/20.1
4,169,453 A * 10/1979 Hunsicker ..... F41B 3/02 124/16
4,411,248 A * 10/1983 Kivenson ..... F41B 3/02 124/20.1
4,458,658 A * 7/1984 Blair ..... F41B 3/02 124/20.1
4,651,707 A * 3/1987 Bozek ..... F41B 5/0094 124/17
4,662,344 A * 5/1987 Mitchell ..... F41B 3/02 124/22
4,703,744 A * 11/1987 Taylor ..... F41B 3/02 124/20.1
4,903,677 A * 2/1990 Colley ..... F41B 5/105 124/23.1
5,054,463 A * 10/1991 Colley ..... F41B 5/10 124/25.6
5,072,715 A * 12/1991 Barr ..... F41B 5/0026 124/17
5,125,388 A * 6/1992 Nicely ..... F41B 3/02 124/20.1
5,243,955 A * 9/1993 Farless ..... F41B 3/005 124/20.1
5,247,920 A * 9/1993 Harbin ..... A63F 9/0252 124/17
5,282,453 A * 2/1994 Chia ..... F42B 6/00 124/20.1
5,345,922 A * 9/1994 Ott ..... F41B 3/02 124/16

(Continued)

*Primary Examiner* — Alexander Niconovich

(74) *Attorney, Agent, or Firm* — LaMorte & Associates, P.C.

(57) ABSTRACT

A toy projectile launching system that launches a toy projectile. A launcher is provided with a first spring loaded spool and a second spring loaded spool. The first spring loaded spool and the second spring loaded spool are disposed on opposite sides of a common open area. At least one first elastic element is at least partially wound around the first spring loaded spool. Likewise, at least one second elastic element is at least partially wound around the second spring loaded spool. A first termination is coupled to each first elastic element. The first termination extends into the common open area. Likewise, a second termination is coupled to each second elastic element. The second termination extends into the common open area. The first termination and the second termination selectively interconnect with the toy projectile.

18 Claims, 5 Drawing Sheets

(56) References Cited

U.S. PATENT DOCUMENTS 5,531,209 A * 7/1996 Liedtke ..... F41B 3/02 124/20.1
5,678,528 A * 10/1997 Hadley ..... F41B 5/12 124/24.1
5,720,268 A * 2/1998 Koltze ..... F41B 5/0094 124/23.1
5,762,056 A * 6/1998 Kysilka ..... F41B 3/02 124/20.1
5,830,029 A * 11/1998 Siegel ..... A63H 33/28 446/15
6,500,042 B1 * 12/2002 LaPointe ..... A63H 33/18 124/20.3
7,448,371 B2 * 11/2008 Sapir ..... F41B 3/005 124/16
7,748,369 B2 * 7/2010 Chee ..... F41B 3/02 124/20.1
8,485,168 B2 * 7/2013 Walterscheid ..... F41B 3/02 124/20.1
2009/0032002 A1 * 2/2009 Howard et al. ..... 124/25.6
2010/0263649 A1 * 10/2010 Fields ..... F41B 7/00 124/17
2013/0167819 A1 * 7/2013 Walterscheid ..... F41B 3/02 124/20.1
2014/0251294 A1 * 9/2014 Novikov ..... F41B 7/00 124/20.1
2014/0338647 A1 * 11/2014 Cummings ..... F41B 7/08 124/20.3

* cited by examiner

TOY PROJECTILE LAUNCHER WITH SPRING LOADED SPOOLS

BACKGROUND OF THE INVENTION

1. Field of the Invention

In general, the present invention relates to toy bow systems that project toy arrows into flight. More particularly, the present invention relates to the structure of toy projectile launchers and the mechanisms for loading and releasing projectiles.

2. Prior Art Description

Bow and arrow sets that are designed for children's play have existed throughout recorded history. In the modern era, toy bow and arrow sets typically have a plastic molded bow, a string, and safety-tipped arrows. To ensure safety, the functional design of the bow is also commonly altered. In a real bow, the string has a fixed length. The spring force used to launch an arrow comes from the flexing of the arms of the bow. The problem with this design is its failure mode. If a bow is drawn beyond its limit, then the arms or the string of the bow may break. Depending upon where the breakage occurs, the broken string and/or bow may fly toward the person holding the bow as the stored energy is accidentally released.

To reduce the likelihood of this hazard from occurring, many toy bows are manufactured as static structures. An elastic string is used to create the arrow launching force. If such a bow is overdrawn, there is no significant chance of the bow breaking. Rather, the elastic string can break and will most likely move in a direction away from the person drawing the bow. The failure mode of a string breaking is far less dangerous than the failure mode of the bow breaking. However, the failure mode of broken string does present some danger depending upon where the elastic string breaks and how much energy is stored in the elastic string at the time it breaks.

Toy bows that use a static bow and an elastic string are exemplified by U.S. Pat. No. 5,247,920 to Harbin, entitled Toy Bow; and U.S. Pat. No. 7,748,369 to Chee, entitled Launching Apparatus and Assembly. Such elastic string toy bows are also shown in the applicant's earlier patent application Ser. Nos. 12/878,985 and 13/411,951.

Although toy bows with elastic strings are safer than flexible bows with non-elastic strings, a danger still is present. If an elastic string is stretched into a fully drawn state and the elastic string breaks near its mounting point with the bow, then the broken elastic string may whip toward the person pulling on the elastic string. The broken elastic string therefore has the potential to cause physical danger to the child pulling on the string, especially to the eyes of the child.

Many toy bows that have elastic strings use elastic strings that are made from a synthetic polymer, such as silicon, TPR, or some other synthetic rubber. On the toy, such elastic strings are constantly under tension. As such, if the material of the string creeps or degrades, the elastic string will break. In addition to the danger presented, this stops the toy bow from being functional.

Most all plastic degrades in some fashion over time. However, it has been found that one of the fastest ways to degrade the preferred polymers used for the bowstring is to expose the bowstring to UV light. A bowstring that can last for years inside a home may only last for a few days if taken outside and left in sunlight. Damage caused by exposure to sunlight has therefore caused customers to return products and/or consumer's to be dissatisfied.

A need therefore exists for a toy bow and arrow design that inhibits degradation in the elastic string caused by exposure to light. A need also exists for a toy bow and arrow design that eliminates the dangers to a child who may overdraw the bow to a point of string failure. These needs are met by the present invention as described and claimed below.

SUMMARY OF THE INVENTION

The present invention is a toy projectile launching system that launches a toy projectile. A launcher is provided with a first spring loaded spool and a second spring loaded spool. The first spring loaded spool and the second spring loaded spool are disposed on opposite sides of a common open area.

At least one first elastic element is at least partially wound around the first spring loaded spool. Likewise, at least one second elastic element is at least partially wound around the second spring loaded spool.

A first termination is coupled to each first elastic element. The first termination extends into the common open area. Likewise, a second termination is coupled to each second elastic element. The second termination extends into the common open area. The first termination and the second termination selectively interconnect with the toy projectile. As the toy projectile is drawn through the common central open area, it engages the first and second terminations. The projectile applies tension to the various elastic elements. The tension causes the elastic elements to unwind from the spring loaded spools and stretch. The spring energy stored on the spools and the elastic energy stored in the elastic elements is then used to launch the toy projectile into flight.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention projectile launching system can be embodied in many ways, only two embodiments of the present invention system are illustrated. These embodiments are selected in order to set forth two of the best modes contemplated for the invention. The illustrated embodiments, however, are merely exemplary and should not be considered limitations when interpreting the scope of the appended claims.

Figure 1:
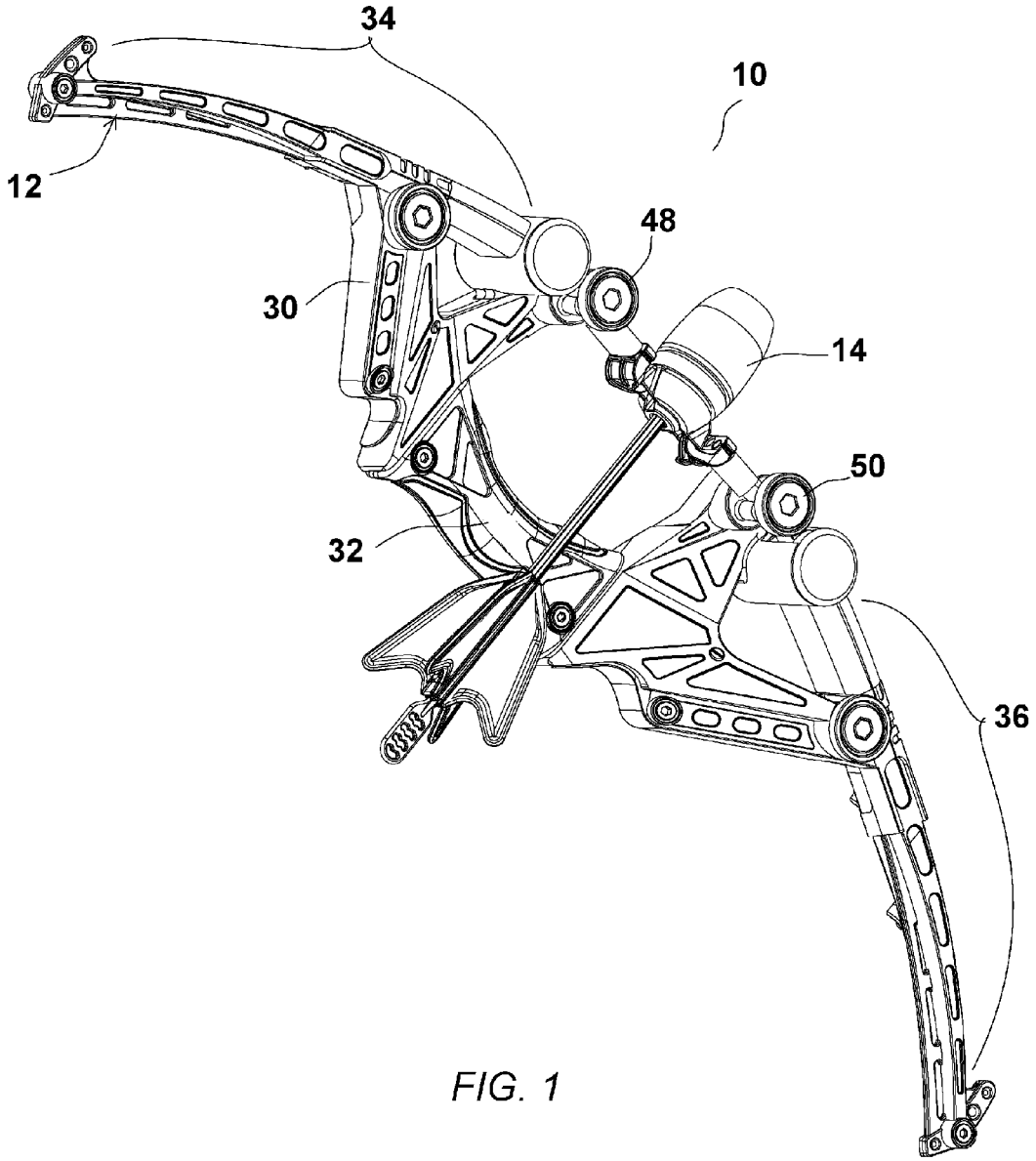
FIG. 1 is a perspective view of an exemplary embodiment of a launching system containing a toy launcher and a toy projectile in combination.
Figure 2:
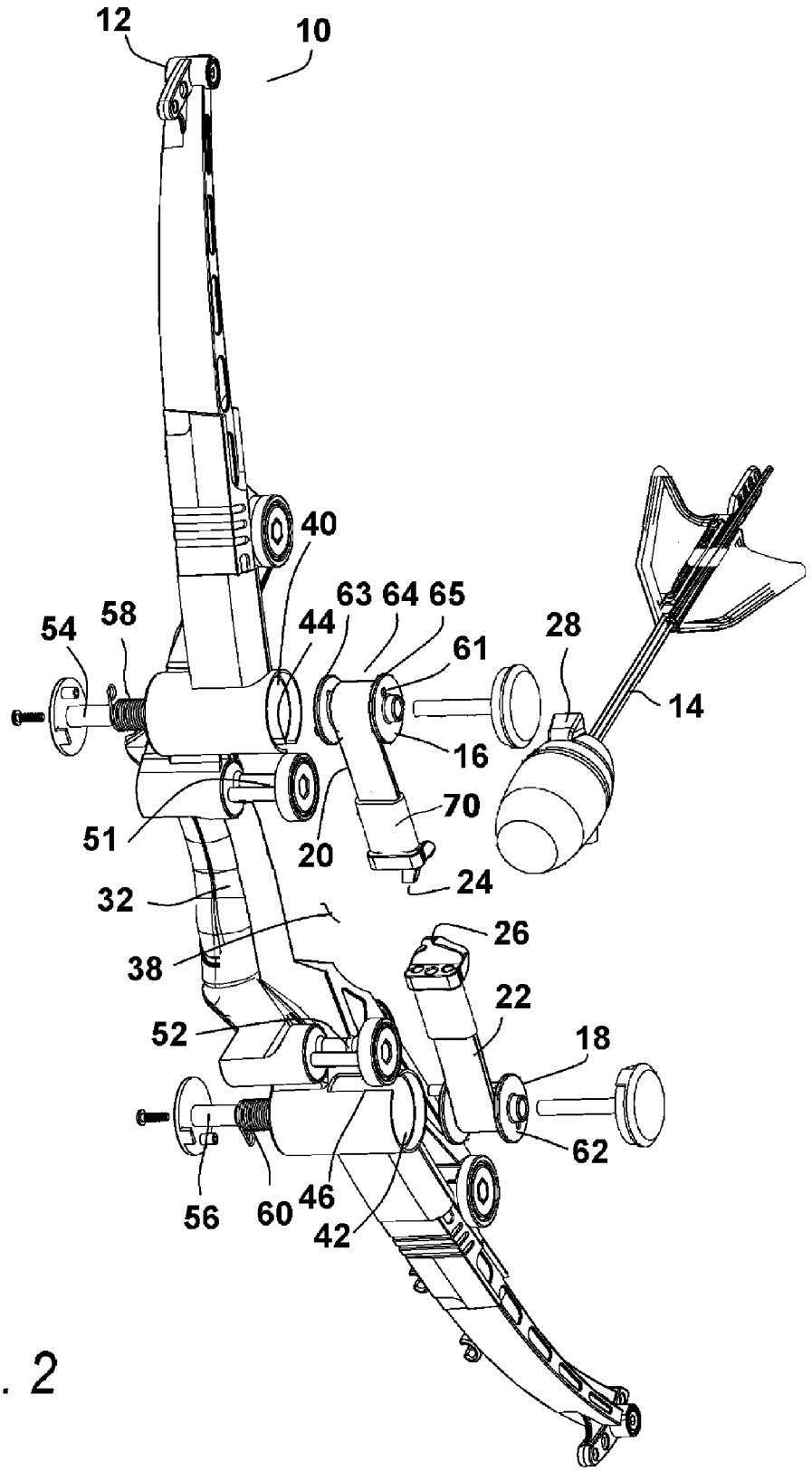
FIG. 2 is an exploded perspective view of the exemplary system of FIG. 1.

Referring to FIG. 1 in conjunction with FIG. 2, a projectile launching system 10 is shown. The projectile launching system 10 includes a launcher 12 and at least one toy projectile 14. The launcher 12 includes two spring-loaded spool assemblies 16, 18. Elastic elements 20, 22, are wound within the spring loaded spool assemblies 16, 18. The force used to propel the toy projectile 14 is provided by the spring energy stored by the spring-loaded spool assemblies 16, 18 and the stretching of the elastic elements 20, 22.

The elastic elements 20, 22 are connected to launching hooks 24, 26. The toy projectile 14 has hook receptacles 28 that engage the launching hooks 24, 26. As a person engages the toy projectile 14 with the launching hooks 24, 26 and pulls on the toy projectile 14, the elastic elements 20, 22, unwind from the spring loaded spool assemblies 16, 18 and stretch in tension. Since there are multiple elastic elements 20, 22, each of the elastic elements 20, 22 need only provide part the force needed to propel the toy projectile 14 into flight. The elastic elements 20, 22 are therefore difficult to overstretch in the proper operation of the projectile launching system 10. Furthermore, since the toy projectile 14 engages multiple separate and distinct elastic elements 20, 22, the chance of all the elastic elements 20, 22, breaking simultaneously is highly improbable. Accordingly, if one elastic element were to break, the toy projectile 14 would still be engaged with other elastic elements and the person pulling the toy projectile 14 will not pull the toy projectile 14 into himself/herself at the time of the breakage.

The launcher 12 includes a rigid plastic framework 30. The framework 30 has a handle 32 and two supports 34, 36 that extend from opposite ends of the handle 32. The two supports 34, 36 are generally coplanar. However, the handle 32 is offset from the plane shared by the supports 34, 36. The offset of the handle 32 creates a central open area 38 that is generally C-shaped, being defined on one side by the handle 32 and on the top and bottom by the two supports 34, 36.

The supports 34, 36 of the framework 30 are shaped as the arms of a bow. However, in the present invention, the supports 34, 36 serve as aesthetic elements and are not required for the function of the toy. Rather, the mechanism used to launch the toy projectile 14 is contained within the spring-loaded spool assemblies 16, 18 and the resiliency of the elastic elements 20, 22 that are wound within the spring loaded spool assemblies 16, 18.

The spring-loaded spool assemblies 16, 18 are carried by the framework 30. Two cylindrical compartments 40, 42 are formed in the framework 30. The cylindrical compartments 40, 42 are parallel and are oriented to be perpendicular to the primary vertical progression of the handle 32. The first cylindrical compartment 40 is located near the forward most part of the first support 34. Similarly, the second cylindrical compartment 42 is also located near the forward most part of the second support 36. The two cylindrical compartments 40, 42 are positioned above and below the central open area 38 created by the offset handle 32.

Slots 44, 46 are formed in the cylindrical compartments 40, 42. The slots 44, 46 face toward each other across the central open area 38. Two guides 48, 50 are provided. The guides 48, 50 are positioned above and below the central open area 38 created by the offset handle 32. The guides 48, 50 are positioned directly between the cylindrical compartments 40, 42 and the central open area 38. Each of the guides 48, 50 contains two narrow passages 51, 52. Each of the narrow passages 51, 52 is sized to enable a length of one of the elastic elements 20, 22 to extend therethrough. The narrow passages 51, 52 are aligned with the slots 44, 46 in the cylindrical compartments 40, 42.

The spring-loaded spool assemblies 16, 18 are set into the cylindrical compartments 40, 42. The spring loaded spool assemblies 16, 18 have central posts 54, 56 that are concentrically positioned within the cylindrical compartments 40, 42. Torsion springs 58, 60 are set around the central posts 54, 56. Spools 61, 62 are placed around the central posts 54, 56. The torsion springs 58, 60 have ends that engage the spools 61, 62 and opposite ends that engage the central posts 54, 56. In this manner, when the spools 61, 62 are rotated on the central posts 54, 56, they cause the torsion springs 58, 60 to rotate and store spring energy.

Each of the spools 61, 62 contains two end flanges 63, 65. The end flanges 63, 65 guide the elastic elements 20, 22 on and off the spools 61, 62 and the spools 61, 62 rotate.

The projectile launching 12 includes the use of two separate and distinct elastic elements 20, 22, wherein one of the elastic elements is dedicated to each of the spring-loaded spool assemblies 16, 18. The first elastic elements 20 attaches to the first spring loaded spool assembly 16. The first elastic element 20 has one end that is anchored to the first spool 61. The second elastic element 22 is anchored to the second spool 62. The opposite ends of both the first and second elastic elements 20, 22 attach to the first and second launching hook 24, 26, respectively.

Both lengths of the elastic elements 20, 22 pass through short lengths of reinforcement tubing 70 just prior to attaching to the first launching hook 24 or the second launching hook 26. The elastic elements 20, 22 are prevented from tangling and/or over retracting into the spring loaded spool assemblies 16, 18 by the guides 48, 50. The elastic elements 20, 22 pass through the passages 51, 52 in the two guides 48, 50. The guides 48, 50 are sized to enable the elastic elements 20, 22 to pass. However, the reinforcement tubing 70 is too large to pass through the passages 51, 52. Consequently, the sections of the elastic elements 20, 22 that pass through the reinforcement tubing 70 remain dangling below the guides 48, 50 in the central open area 38. Likewise, the launching hooks 24, 26 supported by the elastic elements 20, 22 remain dangling in the central open area 38.

Each of the elastic elements 20, 22 is made from a highly elastic elastomeric material that enables each of the elastic elements 20, 22, to resiliently stretch at least threefold without breaking. In the shown embodiments, the elastic elements 20, 22 are shaped as belts with generally rectangular cross-sectional profiles. It will be understood that the elastic elements 20, 22 can have many shapes and can be configured as cords or braided elements.

Figure 3:
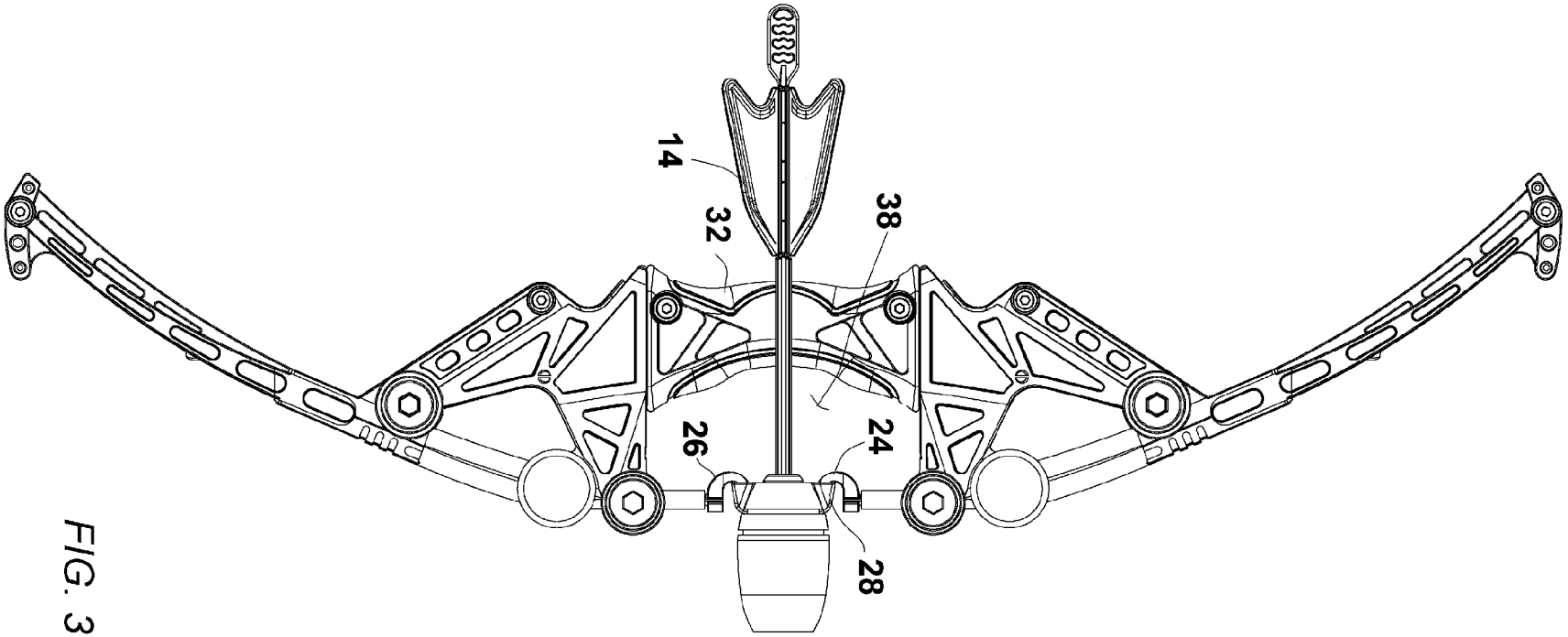
FIG. 3 is a side view of the exemplary system of FIG. 1 with the toy projectile shown in an undrawn condition.
Figure 4:
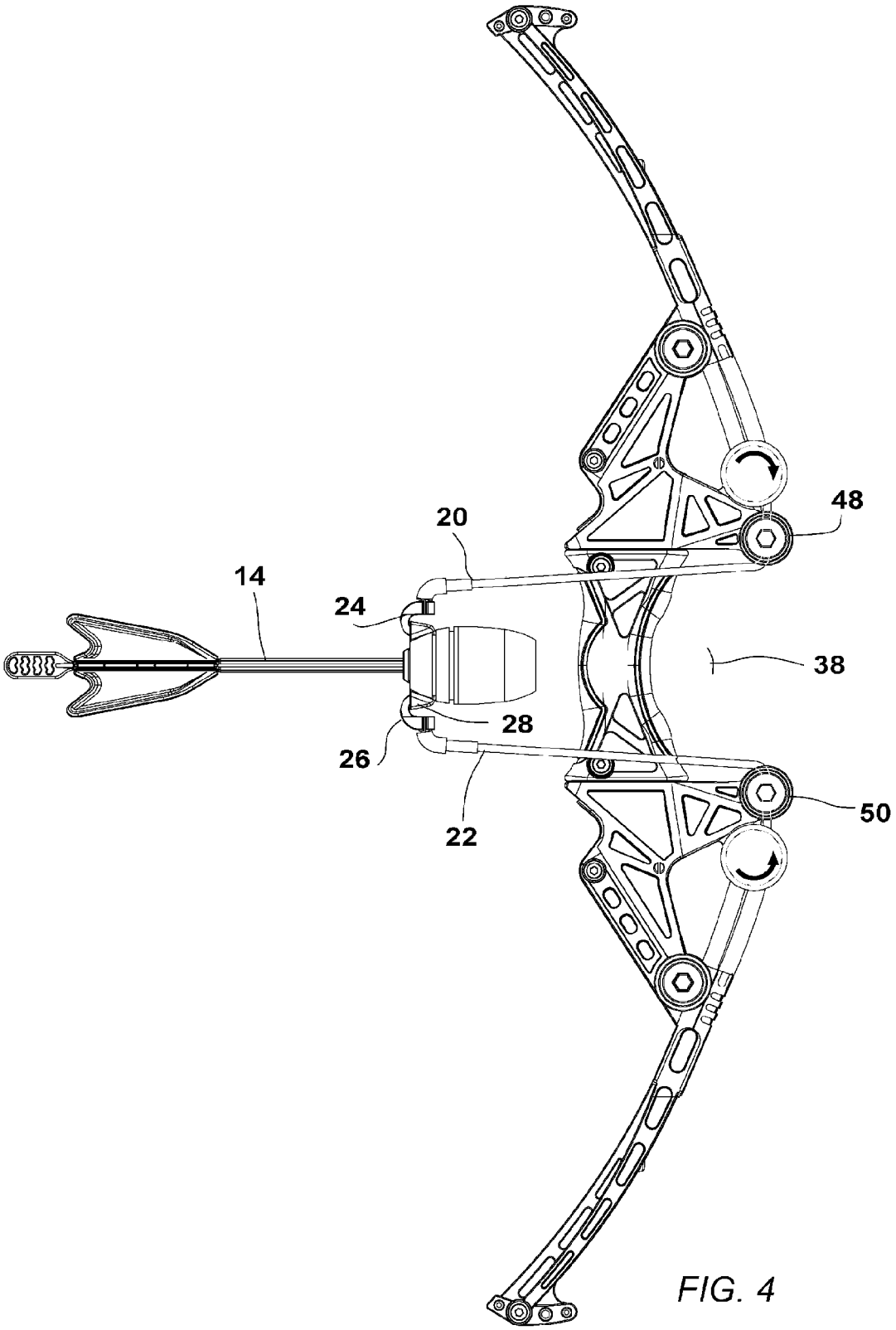
FIG. 4 is a side view of the exemplary system of FIG. 1 with the toy projectile shown in a fully drawn condition.

Referring to both FIG. 3 and FIG. 4 in combination with FIG. 2, it can be seen that the toy projectile 14 has two hook receptacles 28 extending from opposite sides. The hook receptacles 28 are sized and shaped to be engaged by the launching hooks 24, 26 as the projectile 14 is pulled through the central open area 38.

To load the toy projectile 14, the toy projectile 14 is drawn through the central open area 38 so that the launching hooks 24, 26 engage the hook receptacles 28. Once engaged with the launching hooks 24, 26, the toy projectile 14 is pulled in the manner of a traditional bow and arrow. As the toy projectile 14 is drawn away through the central open area 38, the elastic elements 20, 22 are pulled in tension. This causes the elastic elements 20, 22 to unwind from the spring loaded spool assemblies 16, 18. This causes the spools 61, 62 to rotate and the torsion springs 58, 60 to turn and store spring energy. Furthermore, when the elastic elements 20, 22 are fully unwound from the spools 61, 62, the elastic elements 20, 22 stretch and store elastic energy.

When the toy projectile 14 is released, the elastic elements 20, 22 contract and release the stored elastic energy. Likewise, the torsion springs 58, 60 recoil the spools 61, 62 and release the stored spring energy. As a result, the toy projectile 14 is accelerated through the central open area 38. The momentum of the toy projectile 14 causes the toy projectile 14 to continue its forward movement past the central open area 38. This launches the toy projectile 14 into flight as the launching hooks 24, 26 disengage the hook receptacle 28.

The strength of the torsion springs 58, 60 are preferably coordinated with the strength of the elastic elements 20, 22. In this manner, the spools 61, 62 unwind just as the elastic elements 20, 22 reach their optimal degree of elongation.

The launcher 12 is normally in the condition shown in FIG. 1 and FIG. 3. That is, the elastic elements 20, 22 are normally unstretched. In this condition, most of the lengths of the elastic elements 20, 22 are wound onto the spools 61, 62 inside the spring loaded spool assemblies 16, 18. As such, the elastic elements 20, 22 are shielded from ambient light and UV damage. Furthermore, the small segments of the elastic elements 20, 22 that extend from the guides 48, 50 are protected by the reinforcement tubing 70 and are thus protected from ambient light. The only time that the elastic elements 20, 22 are exposed to light are when the elastic elements 20, 22 are fully stretched (FIG. 4) prior to launching a toy projectile 14. This exposure is only momentary. Thus, during the life of the toy, the elastic elements 20, 22 have very little exposure to ambient light.

Figure 5:
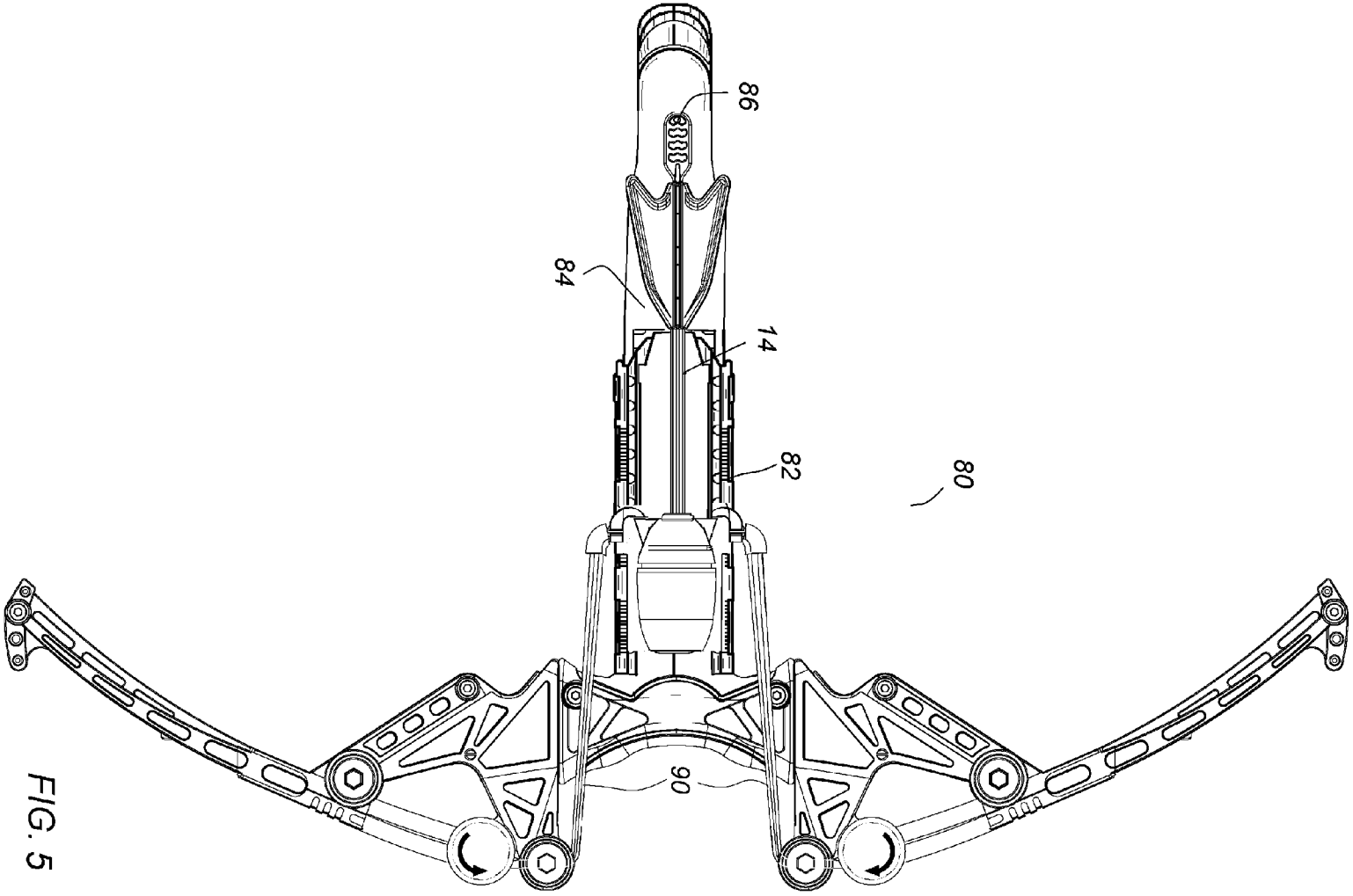
FIG. 5 shows a top view of an alternate embodiment of the toy launcher configured as a crossbow and having alternate elastic elements.

Referring to FIG. 5, an alternate embodiment of a launcher 80 is shown. In this embodiment, the launcher 80 is configured as a crossbow 82. The crossbow 82 operates in the manner previously described. However, the handle is configured as a crossbow stock 84 that can hold a toy projectile 14 in a loaded position. A catch 86 is provided on the stock 84 that engages the toy projectile 14 and prevents it from launching. The catch 86 is operated by a trigger mechanism that is positioned under the stock 84. When a user activates the trigger mechanism, the toy projectile 14 is released by the catch 86 and the toy projectile 14 is launched into flight.

In FIG. 5 an alternate configuration for the elastic elements is also shown. In previous embodiments, the elastic elements were flat bands. However, in the embodiment of FIG. 5, the elastic elements 90 are configured as lengths of elastic cords.

It will be understood that the embodiments of the present invention that are illustrated and described are merely exemplary and that a person skilled in the art can make many variations to those embodiments. For instance, the bow structure can have many different ornamental shapes. Likewise, the toy projectiles can be configured as airplanes, rocket ships or any other flying projectile. All such embodiments are intended to be included within the scope of the present invention as defined by the claims.

What is claimed is:

1. A toy projectile launching system, comprising:
- a toy projectile;
- a launcher including,
  - a first spring loaded spool;
  - a second spring loaded spool, wherein said first spring loaded spool and said second spring loaded spool are disposed on opposite sides of a common open area;
  - a first elastic element having one end anchored to said first spring loaded spool, wherein said first elastic element is at least partially wound around said first spring loaded spool;
  - a second elastic element having one end anchored to said second spring loaded spool, wherein said second elastic element is at least partially wound around said second spring loaded spool;
  - a first termination coupled to said first elastic element that extends into said common open area;
  - a second termination coupled to said second elastic element that extends into said common open area,
- wherein said first termination and said second termination selectively interconnect with said toy projectile.

2. The system according to claim 1, wherein said first spring loaded spool and said second spring loaded spool are shielded from ambient light.

3. The system according to claim 1, further including a first guide, wherein said first elastic element passes through said first guide between said first spring loaded spool and said first termination.

4. The system according to claim 3, further including a second guide, wherein said second elastic element passes through said second guide between said second spring loaded spool and said second termination.

5. The system according to claim 4, further including at least one reinforcement tube, wherein said first elastic element passes through said reinforcement tube between said first guide and said first termination.

6. The system according to claim 4, further including at least one reinforcement tube, wherein said second elastic element passes through said at least one reinforcement tube between said second guide and said second termination.

7. The system according to claim 1, wherein said first termination and said second termination are hook terminations.

8. The system according to claim 1, further including a handle configured as a crossbow stock.

9. A toy projectile launching system, comprising:
- a toy projectile;
- a launcher including,
  - a rigid framework having a handle adjacent an open area;
  - a first spool supported by said framework;
  - a second spool supported by said framework;
  - at least one first elastic element anchored to said first spool, wherein said at least one first elastic element is at least partially wound on said first spool and;
  - at least one second elastic element anchored to said second spool, wherein said at least one second elastic element is at least partially wound on said second spool;
  - a first torsion spring coupled to said first spool, wherein said first torsion spring stores energy when said first elastic element unwinds from said first spool;
  - a second torsion spring coupled to said second spool, wherein said second torsion spring stores energy when said second elastic element unwinds from said second spool;
  - a first termination coupled to said at least one first elastic element that extends into said open area; and
  - a second termination coupled to said at least one second elastic element that extends into said open area,
- wherein said first termination and said second termination selectively interconnect with said toy projectile.

10. The system according to claim 9, wherein said first spool and said second spool are shielded from ambient light.

11. The system according to claim 9, wherein said at least one first elastic element includes two first elastic elements.

12. The system according to claim 11, wherein said at least one second elastic element includes two second elastic elements.

13. The system according to claim 12, further including a first guide, wherein said two first elastic elements pass through said first guide between said first spool and said first termination.

14. The system according to claim 13, further including a second guide, wherein said two second elastic elements pass through said second guide between said second spool and said second termination.

15. The system according to claim 14, further including reinforcement tubes, wherein said two first elastic elements and said two second elastic elements pass through said reinforcement tubes.

16. The system according to claim 9, wherein said first termination and said second termination are hook terminations.

17. The system according to claim 9, wherein said handle is configured as a crossbow stock.

18. The system according to claim 9, wherein said framework includes supports shapes as bow arms.

* * * * *